US009196109B2

(12) United States Patent
Machida et al.

(10) Patent No.: US 9,196,109 B2
(45) Date of Patent: Nov. 24, 2015

(54) AUTOMATIC TRANSACTION APPARATUS THAT GUIDES CONVEYANCE OF A PAPER MEDIUM

(75) Inventors: Katsuhiko Machida, Gunma (JP); Takumi Hashigami, Gunma (JP); Satoshi Goda, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/372,535

(22) Filed: Feb. 14, 2012

(65) Prior Publication Data

US 2013/0068834 A1 Mar. 21, 2013

(30) Foreign Application Priority Data

Sep. 15, 2011 (JP) ..... 2011-201564

(51) Int. Cl.

*G07D 11/00* (2006.01)
*G07F 19/00* (2006.01)
*G07F 7/08* (2006.01)

(52) U.S. Cl.

CPC ..... *G07F 7/0873* (2013.01); *G07D 11/0018* (2013.01); *G07F 19/201* (2013.01); *G07F 19/203* (2013.01)

(58) Field of Classification Search

CPC ..... G07F 19/20; G07F 19/201; G07F 19/205; G07F 19/203; G06Q 20/1085; G07D 11/0003; G07D 11/0018

USPC ..... 235/379, 475, 381, 477, 483; 705/43; 271/3.01, 3.14; 902/8, 18, 36; 221/12, 221/306

See application file for complete search history.

(56) References Cited

U.S. PATENT DOCUMENTS

| | | | | | |
|---|---|---|---|---|---|
| 4,266,121 | A * | 5/1981 | Hirose | ..... | 235/381 |
| 4,463,939 | A * | 8/1984 | Watanabe | ..... | 270/1.02 |
| 5,779,379 | A * | 7/1998 | Mason et al. | ..... | 400/621 |
| 5,850,075 | A * | 12/1998 | Brannan et al. | ..... | 235/379 |
| 5,898,155 | A * | 4/1999 | Imai et al. | ..... | 235/379 |
| 6,428,226 | B1 * | 8/2002 | Suzuki et al. | ..... | 400/642 |

(Continued)

FOREIGN PATENT DOCUMENTS

| | | |
|---|---|---|
| JP | 62-138994 | 6/1987 |
| JP | 63-258329 | 10/1988 |

(Continued)

OTHER PUBLICATIONS

English translation of JP 07-021469 (Shindo). Date of patent: Jan. 24, 1995.*

(Continued)

*Primary Examiner* — Michael G Lee
*Assistant Examiner* — Suezu Ellis
(74) *Attorney, Agent, or Firm* — Rabin & Berdo, P.C.

(57) ABSTRACT

An automatic transaction apparatus includes a card insert port into which a card medium is inserted; a paper medium discharge section that has a discharge port from which a paper medium is discharged; and a conveying path that has a lower guide surface and an upper guide surface that guide conveyance of the paper medium and discharge of the paper medium from the discharge port, a dimension of the conveying path in a thickness direction of the paper medium being smaller than a thickness of the card medium at least at one position of the conveying path along a conveying direction.

11 Claims, 16 Drawing Sheets

(56) References Cited

U.S. PATENT DOCUMENTS

| | | | | |
|---|---|---|---|---|
| 6,630,941 | B1 * | 10/2003 | Addison | 715/702 |
| 7,140,610 | B2 * | 11/2006 | Kako et al. | 271/258.01 |
| 7,275,483 | B2 * | 10/2007 | Knobel | 101/228 |
| 8,033,454 | B2 * | 10/2011 | MacDonald | 235/379 |
| 8,353,511 | B2 * | 1/2013 | Tozaki | 271/279 |
| 8,469,264 | B1 * | 6/2013 | Almeida | G07F 19/205 235/379 |
| 2003/0007823 | A1 * | 1/2003 | Tsuchiya et al. | 400/617 |
| 2009/0090774 | A1 * | 4/2009 | Ito | 235/383 |
| 2009/0118861 | A1 * | 5/2009 | Kanagawa et al. | 700/231 |

FOREIGN PATENT DOCUMENTS

| | | | |
|---|---|---|---|
| JP | 2-123666 | | 10/1990 |
| JP | 7-6865 | | 1/1995 |
| JP | 07-021469 | A | 1/1995 |
| JP | 7-302365 | | 11/1995 |
| JP | 09104554 | A * | 4/1997 |
| JP | 2000155860 | A * | 6/2000 |
| JP | 2000-309134 | A | 11/2000 |
| JP | 2002370859 | A * | 12/2002 |
| JP | 2004038542 | A * | 2/2004 |

OTHER PUBLICATIONS

Machine translation of JP 2004-38542 (Ushikubo et al.) Date of patent: Feb. 5, 2004.*

Japanese Office Action issued on Apr. 23, 2013 with an English translation.

Japanese Office Action dated Sep. 2, 2014 with English translation.

* cited by examiner

AUTOMATIC TRANSACTION APPARATUS THAT GUIDES CONVEYANCE OF A PAPER MEDIUM

CROSS-REFERENCE TO RELATED APPLICATION

This application is based on and claims priority under 35 USC 119 from Japanese Patent Application No. 2011-201564, filed on Sep. 15, 2011, the disclosure of which is incorporated by reference herein.

BACKGROUND

1. Technical Field

The present invention relates to an automatic transaction apparatus.

2. Related Art

In recent years, automatic transactions represented by automated teller machine (ATM) of final institutions are installed at various places such as banks, station premises, or convenience stores. Customers can conduct transactions, such as depositing money, withdrawing money or checking account balance, by carrying out various operations on a display screen displayed on the automatic transaction apparatus.

Such an automatic transaction apparatus includes a receipt discharge port for discharging a receipt with transaction information printed thereon, and a card insert/discharge port into which a magnetic card is inserted or from which a magnetic card is discharged. In many cases, the receipt discharge port and the card insert/discharge port are provided near or adjacent to each other so that a customer can receive the card and the receipt discharged from the automatic transaction apparatus in a single movement, for example, as disclosed in Japanese Patent Application Laid-Open (JP-A) No. 7-21469.

However, in a case in which the receipt discharge port and the card insert/discharge port are disposed near or adjacent to each other, it is assumed that a customer is likely to insert a magnetic card into the receipt discharge port by mistake. For this reason, it is conceivable to provide a shutter for opening a discharge passage of the receipt only when the receipt is discharged. In this instance, however, since an actuator is needed to open and close the shutter, the machine becomes larger and the number of components increases. This impairs the workability (ease of maintenance) with respect to the machine and increases a cost.

Alternatively, it is also conceivable of a structure having no shutter and in which an angle of a conveying path in the vicinity to the receipt discharge port is largely turned from a horizontal direction to a vertical direction. Although the magnetic card is difficult to be inserted into the receipt discharge port with this structure, this cannot completely prevent a mistaken insertion of the magnetic card.

SUMMARY

The invention has been made in view of the above, and provides a new, improved automatic transaction apparatus capable of more reliably preventing a mistaken insertion of a card medium.

One aspect of the invention is an automatic transaction apparatus including: a card insert port into which a card medium is inserted; a paper medium discharge section that has a discharge port from which a paper medium is discharged; and a conveying path that has a lower guide surface and an upper guide surface that guide conveyance of the paper medium and discharge of the paper medium from the discharge port, a dimension of the conveying path in a thickness direction of the paper medium being smaller than a thickness of the card medium at least at one position of the conveying path along a conveying direction.

In the above aspect, the conveying path may further have a lower guide member that guides the paper medium toward the paper medium discharge section, and a gap between a front end of the lower guide member and the upper guide surface is smaller than the thickness of the card medium.

In the above aspect, an upper edge and a lower edge of the discharge port may be formed in a straight line, and a gap between the upper edge and the lower edge may be smaller than the thickness of the card medium.

In the above aspect, an upper edge and a lower edge of the discharge port may be formed in a curved line, and a gap between a lower end of the upper edge and an upper end of the lower edge in the thickness direction may be smaller than the thickness of the card medium.

In the above aspect, the lower end of the upper edge may be positioned lower than the upper end of the lower edge.

In the above aspect, the upper guide surface and the lower guide surface of the conveying path respectively may have a protrusion member, and a gap between a lower end of the protrusion member of the upper guide surface and an upper end of the protrusion member of the lower guide surface in the thickness direction may be smaller than the thickness of the card medium.

In the above aspect, the lower end of the protrusion member of the upper guide surface may be positioned at a position lower than the upper end of the protrusion member of the lower guide surface.

In the above aspect, the paper medium discharge section may further have a shutter which is urged in a direction of covering the discharge port.

In the above aspect, the automatic transaction apparatus may further include a sensor that detects a medium inside the conveying path; and a control section that, if a medium is detected by the sensor when the paper medium is not being conveyed, controls conveyance of the medium to discharge the medium.

In the above aspect, the automatic transaction apparatus may further include a display section, wherein if a medium is detected by the sensor, the control section displays a guidance screen on the display section, that guides a user through a correction operation.

In the above aspect, the at least one position of the conveying path along the conveying direction may be less than a length of the card medium in an insertion direction from the discharge port.

As described above, the aspects of the invention can more reliably prevent a mistaken insertion of the card medium.

BRIEF DESCRIPTION OF THE DRAWINGS

Exemplary embodiments of the present invention will be described in detail based on the following figures, wherein.

DETAILED DESCRIPTION

Figure 1:
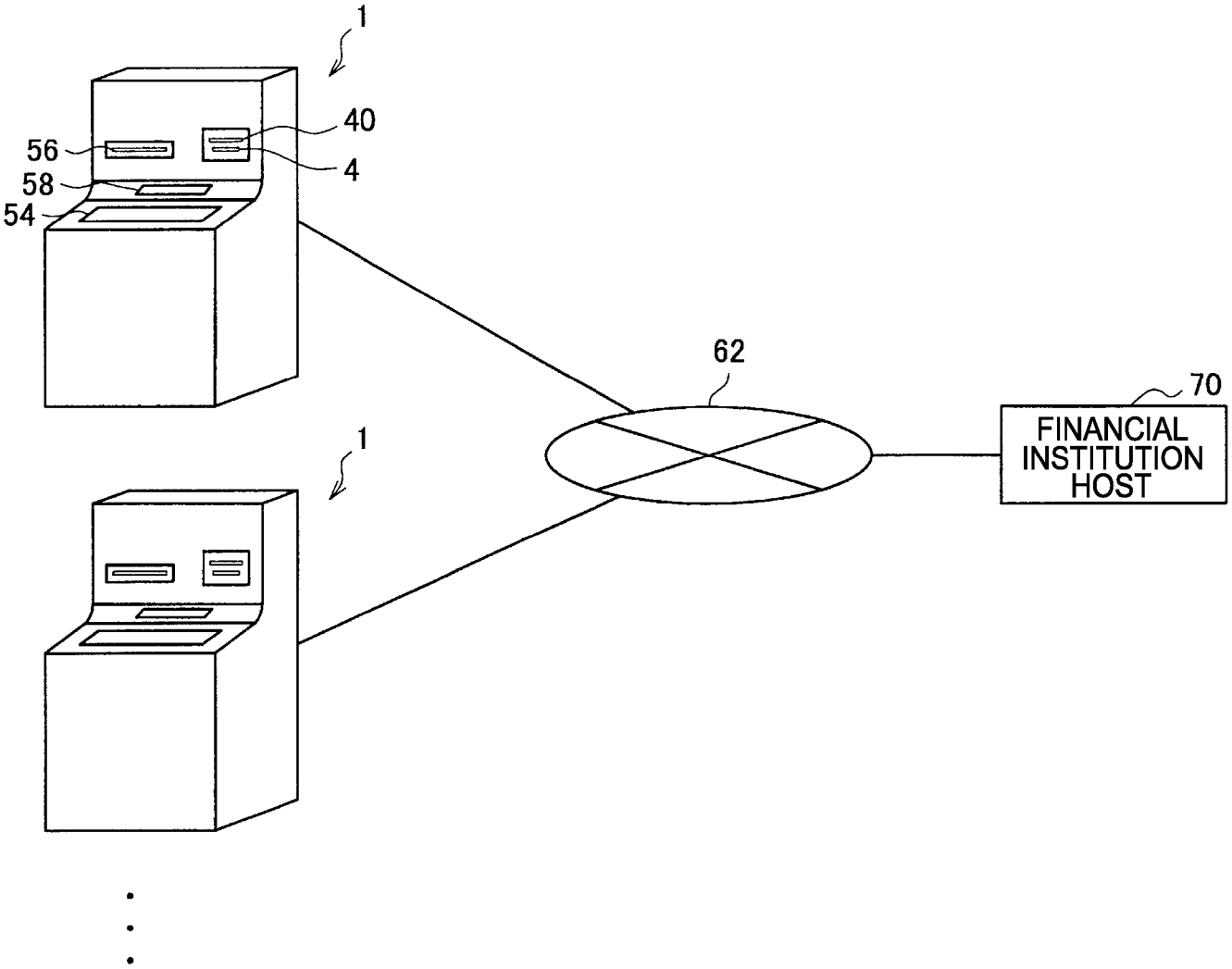
FIG. 1 is an explanatory diagram illustrating a configuration of an automatic transaction system according to an embodiment of the invention.

Hereinafter, embodiments of the present invention will now be described in detail with reference to the accompanying drawings. Components having a substantially same functional configuration are denoted by a same reference numeral throughout the description and drawings, and thereby the explanations thereof are omitted.

1. Basic Configuration of Automatic Transaction Apparatus and Automatic Transaction System The present invention can be implemented in various forms, as described in detail in "3-1. First Embodiment" through "3-8. Eighth Embodiment", as examples. An automatic transaction apparatus 1 according to the exemplary embodiments include:

A. a card insert port (card insert/discharge port 4) into which a card medium (magnetic card 12) is inserted;

B. a paper medium discharge section (receipt discharge sections 31 to 35) having a discharge port (receipt discharge port 40) from which a paper medium is discharged; and C. a conveying path that guides a conveyance of the paper medium and a discharge of the paper medium from the discharge port by a lower guide surface and an upper guide surface, D. wherein a width of the conveying path in a thickness direction of the paper medium at least a position along a conveying direction of the conveying path is less than a thickness of the card medium.

Hereinafter, the basic configurations of the automatic transaction apparatus and an automatic transaction system including the automatic transaction apparatus, which are common between the exemplary embodiments, will be described with reference to FIG. 1.

FIG. 1 is an explanatory diagram illustrating the configuration of the automatic transaction system according to the exemplary embodiments. As illustrated in FIG. 1, the automatic transaction system according to the embodiments includes plural automatic transaction apparatus 1, a private (dedicated) network 62, and a financial institution host 70.

The automatic transaction apparatus 1 is a self-service terminal of a financial institution which implements monetary transaction based on operation of a customer (user). The automatic transaction apparatus 1 can be installed at various facilities such as banking offices of financial institutions, convenience stores, station premises, hotels, hospitals, amusement parks, restaurants, or office buildings.

The automatic transaction apparatus 1 includes a card insert/discharge port 4, a receipt discharge port 40, an operation display section 54, a passbook insert port 56, and a customer service port 58. The operation display section 54 has a function of a display section that displays a guidance screen for guiding the operation of the customer and a function of a customer operating section that detects the operation of the customer. The function of the display section is achieved by, for example, a cathode ray tube (CRT) display device, a liquid crystal display (LCD) device, or an organic light emitting diode (OLED) device. The function of the customer operating section is achieved by, for example, a touch panel. Although FIG. 1 illustrates an example in which the function of the display section and the function of the customer operating section are integrally configured in the automatic transaction apparatus 1, the function of the display section and the function of the customer operating section may separately be configured.

The passbook insert port 56 carries out the insertion and discharge of the customer's passbook. In addition, the customer service port 58 has a function of a deposit port for receiving bills from the customer and a function of a withdraw port for discharging bills to the customer.

The card insert/discharge port 4 is an opening into which a magnetic card of the customer is inserted and from which the magnetic card of the customer is discharged. The receipt discharge port 40 is an opening for discharging a receipt on which transaction information is printed. The card insert/discharge port 4 and the receipt discharge port 40 are disposed adjacent to each other in a vertical direction, as illustrated in FIG. 1, so that the customer can receive the magnetic card discharged from the card insert/discharge port 4 and the receipt discharged from the receipt discharge port 40 in a single movement (action).

The private network 62 is a network for a financial institution which is constructed by, for example, Internet Protocol-Virtual Private Network (IP-VPN). The financial institution host 70 can communicate with the automatic transaction apparatus 1 through the private network 62.

The financial institution host 70 effects control of various transactions by communicating with the automatic transaction apparatus 1 through the private network 62. For example, the financial institution host 70 conducts authentication of the customer operating the automatic transaction apparatus 1, or carries out the monetary transaction (transaction processing of account), such as deposit and transfer, instructed by the customer to the automatic transaction apparatus 1. Further, the financial institution host 70 manages customer's information (ledger of account) such as an account number, a password, a name, an address, an age, a date of birth, a telephone number, an occupation, family members, an annual income, and a deposit balance.

The embodiments relate to the automatic transaction apparatus 1 included in the automatic transaction system as described above, and in particular, to the configuration of the receipt discharge port 40 of the automatic transaction apparatus 1 and the peripheral thereof. Hereinafter, the configuration of the receipt discharge port 40 of the automatic transaction apparatus and the peripheral thereof according to a comparative example will be described, and then, the embodiments will be described in detail.

Figure 2:
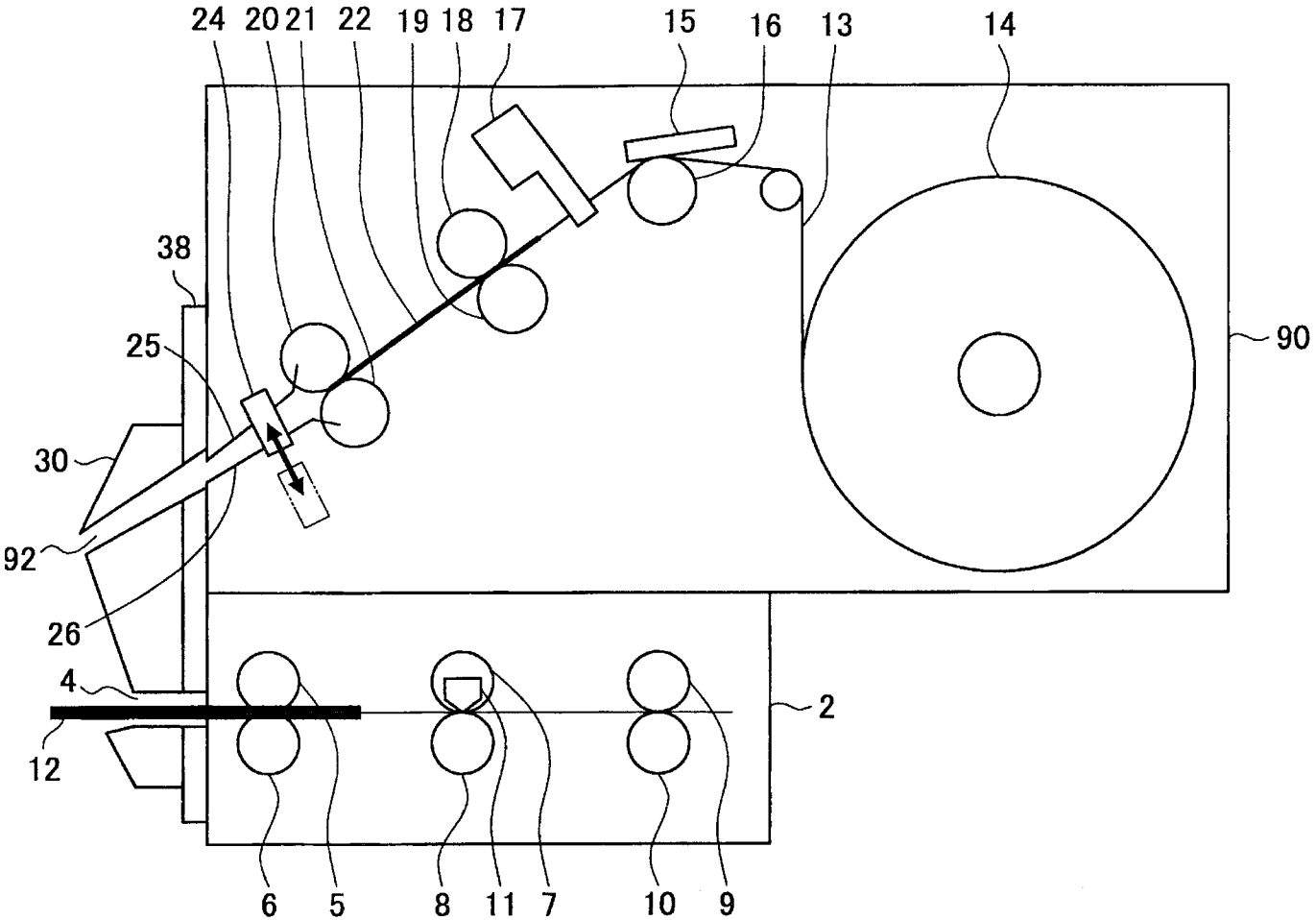
FIG. 2 is an explanatory diagram illustrating a configuration of an automatic transaction apparatus according to a comparative example of the invention.

2. Automatic Transaction Apparatus According to Comparative Example Configuration FIG. 2 is an explanatory diagram illustrating the configuration of the automatic transaction apparatus according to a comparative example. As illustrated in FIG. 2, the automatic transaction apparatus according to the comparative example includes a card reader/writer 2 and a receipt printer 90.

The card reader/writer 2 includes a card insert/discharge port 4, feeding rollers 5 to 10, and a magnetic reading section 11. The magnetic reading section 11 reads data on a magnetic card 12 which is a card medium. The data read by the magnetic reading section 11 is sent to a control section, and the control section effects control of a transaction based on the data.

The receipt printer 90 includes a receipt roll 14 wound by continuous paper 13, a thermal head 15, a platen 16, a cutter knife 17, feeding rollers 18 to 21, a shutter 24, an upper guide 25 (upper guide member), and a lower guide 26 (lower guide member).

The thermal head 15 prints predetermined transaction information on the continuous paper 13 which is conveyed onto the platen 16. The cutter knife 17 cuts the portion of the continuous paper 13, on which the transaction information is printed, into a sheet of receipt 22 which is a medium having a leaf-form and having a thickness thinner than that of the magnetic card 12. The feeding rollers 18 to 21 convey the receipt 22 towards the receipt discharge port 92.

The shutter 24 is moved by an actuator (not illustrated) such as a plunger magnet to a position which opens the conveying path of the receipt 22 when the receipt 22 is discharged. The upper guide 25 and the lower guide 26 guide the receipt 22 toward the receipt discharging section 30 having the receipt discharge port 92. The receipt discharging section 30 is mounted to a machine body via a frame 38.

Operation

Next, the transaction operation of the automatic transaction apparatus according to the comparative example having the above-described configuration will now be described. When a customer inserts the magnetic card 12 through the card insert/discharge port 4 and the magnetic card 12 is sandwiched between the feeding rollers 5 and 6, the feeding rollers 5 to 10 rotate and convey the magnetic card 12 to the magnetic reading section 11. The magnetic reading section 11 reads data of the magnetic card 12 which is a card medium. The data read by the magnetic reading section 11 is sent to the control section, and the control section effects control of a transaction based on the data.

The control section causes the thermal head 15 to print transaction information on the continuous paper 13. Due to rotation of the platen 16, the continuous paper 13 is fed by a predetermined amount in a direction toward the receipt discharge port 92, and the continuous paper 13 is cut by the cutter knife 17 into the receipt 22. Due to rotations of the feeding rollers 18 to 21, the receipt 22 is conveyed toward the receipt discharge port 92.

When the receipt 22 is conveyed toward the receipt discharge section 30, the shutter 24 is opened by the actuator which is not illustrated. Thus, since the shutter 24 is opened only when the receipt 22 is discharged, even if the customer inserts the magnetic card 12 into the receipt discharge port 92 by mistake, the front end of the magnetic card 12 abuts to the shutter 24, and the magnetic card 12 is prevented from being inserted into the receipt printer 90.

The receipt 22 is guided by the upper guide 25 and the lower guide 26, and then discharged from the receipt discharge port 92. In synchronization with the discharge timing of the receipt 22, the feeding rollers 5 to 10 of the card reader/writer 2 rotate, and the magnetic card 12 is discharged from the card insert/discharge port 4.

As described above, since the automatic transaction apparatus according to the comparative example requires an actuator for opening and closing the shutter 24, the machine becomes larger and the number of components increases, which aggravates the workability to and pushes up the cost.

Alternatively, it is also possible to adopt a structure having no shutter and in which an angle of the conveying path in the vicinity of the receipt discharge port is largely turned from the horizontal direction to the vertical direction. However, although the magnetic card is difficult to be inserted into the receipt discharge port in the structure, it cannot completely prevent a mistaken insertion of the magnetic card.

The automatic transaction apparatus according to the embodiments are invented in consideration of the above-described circumstance. The automatic transaction apparatus according to the embodiments can more reliably prevent a mistaken insertion of the magnetic card. Hereinafter, each of the embodiments will now be sequentially described in detail.

3. Detailed Description of Embodiments

3-1 First Embodiment

Figure 3:
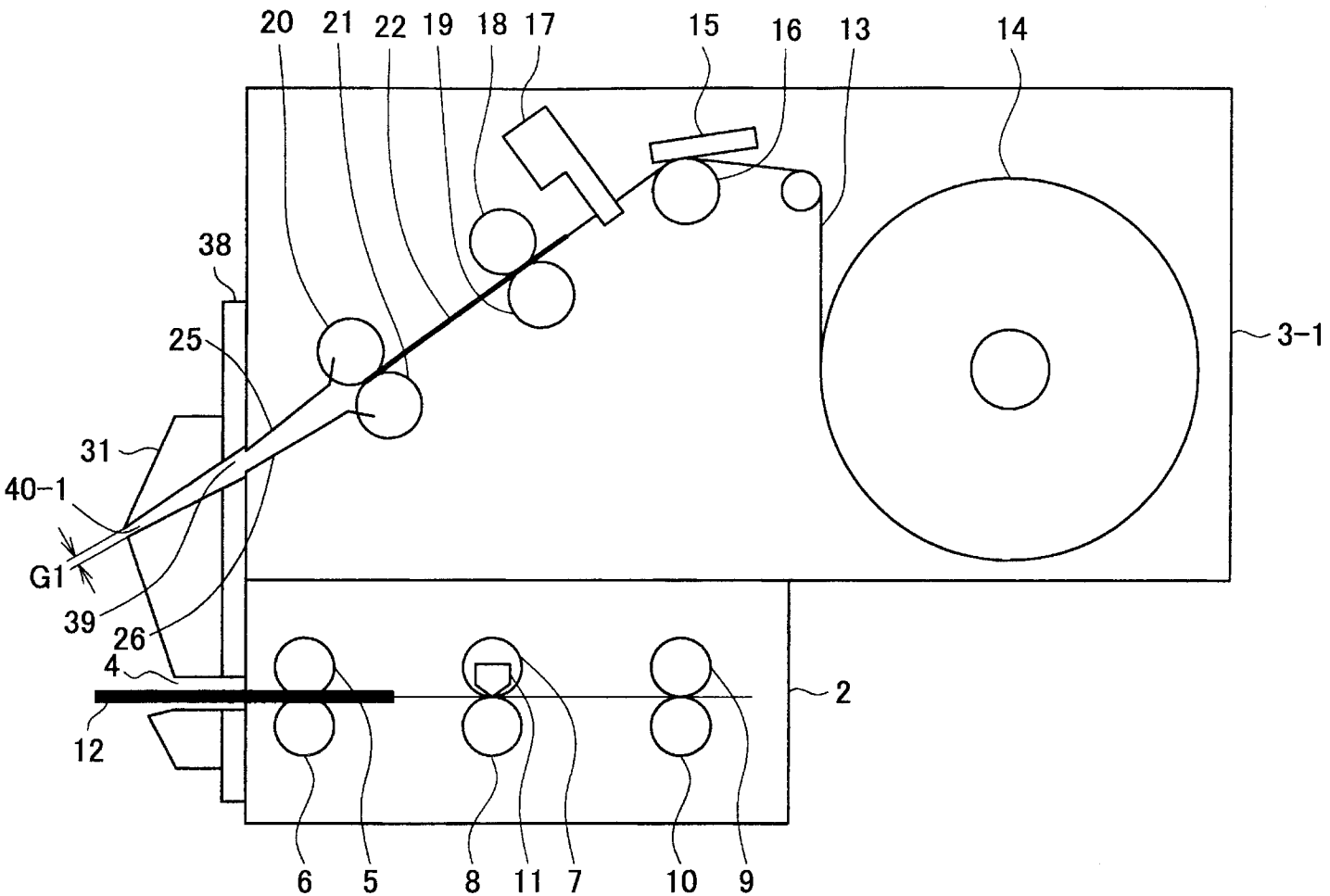
FIG. 3 is an explanatory diagram illustrating a configuration according to a first exemplary embodiment.
Figure 4:
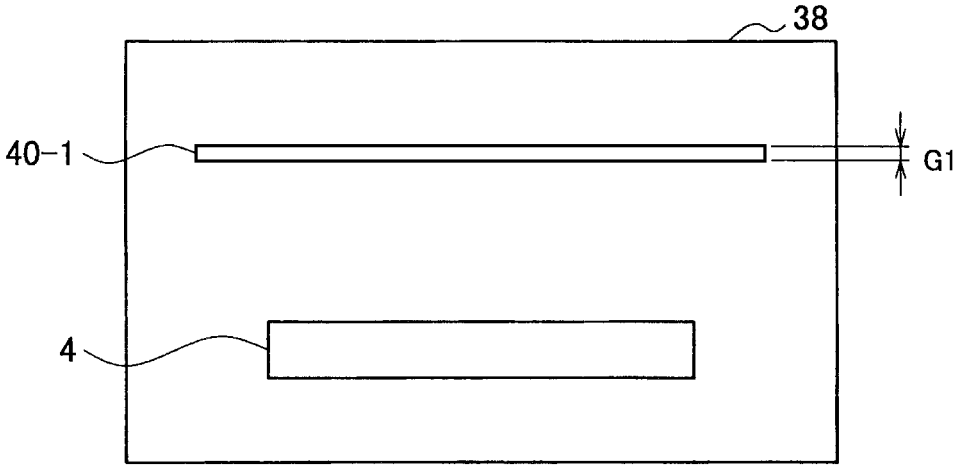
FIG. 4 is a front view of a card insert/discharge port and a receipt discharge port according to the first exemplary embodiment.

FIG. 3 is an explanatory diagram illustrating the configuration according to a first exemplary embodiment. FIG. 4 is a front view of the card insert/discharge port 4 and a receipt discharge port 40-1 according to the first embodiment. As illustrated in FIG. 3, the automatic transaction apparatus 1 according to the first embodiment includes the card reader/writer 2 and a receipt printer 3-1. Note that the configuration of the card reader/writer 2 is as described in the configuration of the automatic transaction apparatus according to the comparative example, and the detailed description is hence not provided herein.

The receipt printer 3-1 according to the first embodiment includes the receipt roll 14 wound by the continuous paper 13, the thermal head 15, the platen 16, the cutter knife 17, the feeding rollers 18 to 21, the upper guide 25 (upper guide member), and the lower guide 26 (lower guide member). In addition, the receipt roll 14 is wound such that a print surface faces inward, so as to prevent the print surface from being unintentionally printed due to internal friction or heat.

The thermal head 15 prints predetermined transaction information on the continuous paper 13 which is conveyed onto the platen 16. The cutter knife 17 cuts the portion of the continuous paper 13, on which the transaction information is printed, into a sheet of the receipt 22, which is a medium having a leaf-form and having a thickness thinner than that of the magnetic card 12. The feeding rollers 18 to 21 convey the receipt 22 toward the receipt discharge port 40-1.

In addition, the receipt discharge section 31 is mounted on the receipt printer 3-1 via the frame 38. The receipt discharge section 31 includes an opening 39 at a side of the machine body, and the receipt discharge port 40-1. Further, the opening 39 at the machine body side is larger than the receipt discharge port 40-1 in a thickness direction of the receipt 22, and a gap (the height) of a conveying path between the opening 39 at the machine body side and the receipt discharge port 40-1 is gradually reduced (tapered).

In addition, as illustrated in FIG. 4, an upper line (edge) and a lower line (edge) of the receipt discharge port 40-1 according to the first embodiment are formed in a straight line, and a gap G1 between the upper edge and the lower edge is wider than the thickness of the receipt 22, and is narrower than the thickness of the magnetic card 12. The upper edge of the receipt discharge port 40-1 is an end portion of an upper guide surface of the conveying path, and the lower edge of the receipt discharge port 40-1 is an end portion of a lower guide surface of the conveying path.

In the above-described configuration, the receipt 22 is conveyed by the feeding rollers 18 to 21, and is guided toward the receipt discharge section 31 by the upper guide 25 and the lower guide 26. The receipt 22 is sent from the opening 39 at the machine side of the receipt discharge section 31 to the receipt discharge port 40-1. Since the conveying path between the opening 39 at the machine side of the receipt discharge section 31 and the receipt discharge port 40-1 is smoothly formed without any stepped portion or the like, the front end of the receipt 22 is discharged to the outside of the automatic transaction apparatus 1 from the receipt discharge port 40-1 having the gap wider than the thickness of the receipt 22.

As described above, according to the first embodiment, the receipt 22 can be normally discharged to the outside of the automatic transaction apparatus 1 from the receipt discharge port 40-1 having the gap wider than the thickness of the receipt 22. Meanwhile, since the height (gap) of the receipt discharge port 40-1 is narrower than the thickness of the magnetic card 12, it is possible to prevent a mistaken insertion of the magnetic card 12 to the receipt discharge port 40-1.

3-2 Second Embodiment

Figure 5:
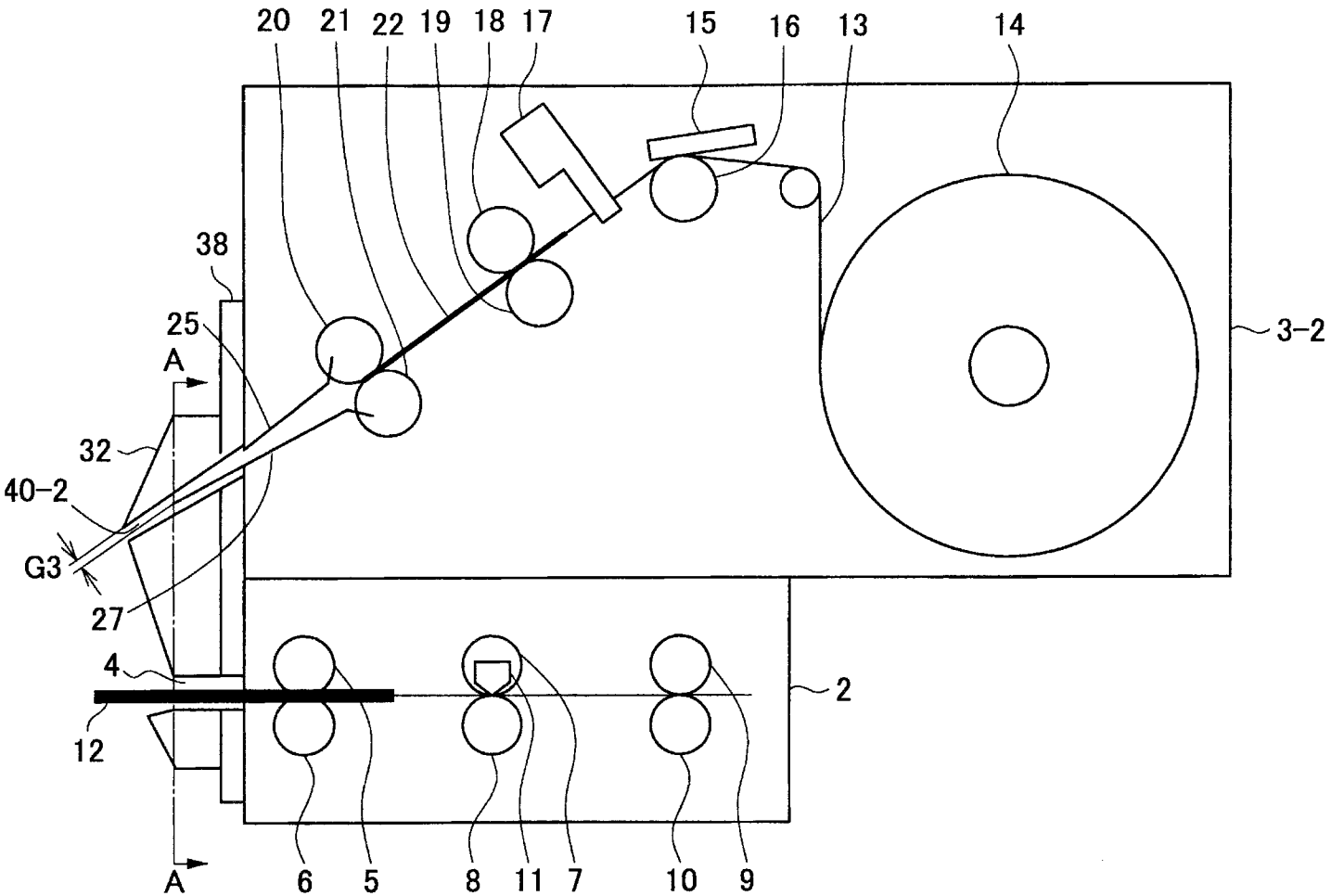
FIG. 5 is an explanatory diagram illustrating a configuration according to a second exemplary embodiment.
Figure 6:
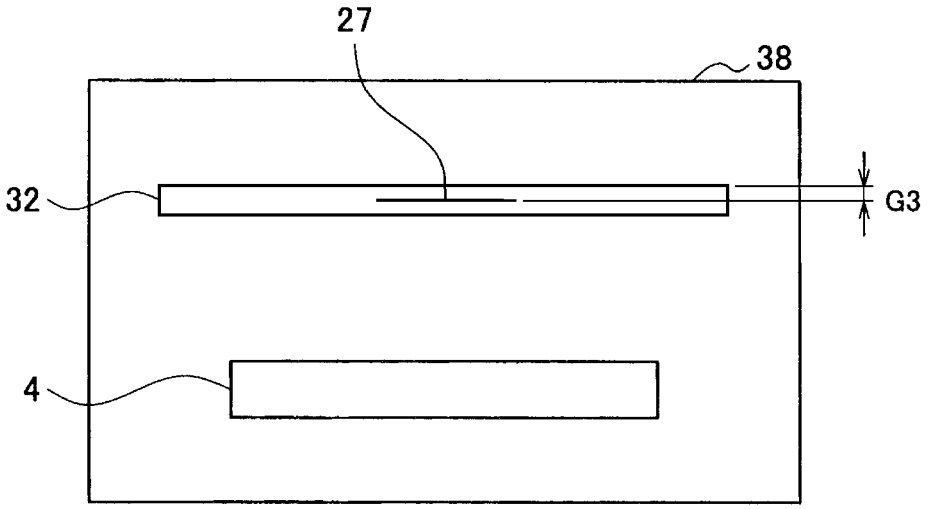
FIG. 6 is an explanatory diagram illustrating a cross section A-A' in FIG. 5.

FIG. 5 is an explanatory diagram illustrating the configuration according to a second exemplary embodiment. FIG. 6 is an explanatory diagram illustrating a cross section A-A' in FIG. 5. As illustrated in FIG. 5, the automatic transaction apparatus 1 according to the second embodiment includes the card reader/writer 2 and a receipt printer 3-2.

The receipt printer 3-2 according to the second embodiment includes the receipt roll 14 wound by the continuous paper 13, the thermal head 15, the platen 16, the cutter knife 17, the feeding rollers 18 to 21, the upper guide 25, and a lower guide 27. Further, a receipt discharge section 32 is mounted on the receipt printer 3-2 via the frame 38. The receipt discharge section 32 includes a receipt discharge port 40-2.

The front end of the lower guide 27 is positioned in the conveying path of the receipt discharge section 32. Further, as illustrated in FIGS. 5 and 6, a gap G3 between the front end of the lower guide 27 and the upper guide surface of the conveying path of the receipt discharge section 32 is wider than the thickness of the receipt 22, and is narrower than the thickness of the magnetic card 12. Note that it is not necessary for the front end of the lower guide 27 to have the same width as the conveying path, and, as illustrated in FIG. 6, it is sufficient that the front end is positioned at a position which abuts against the magnetic card 12 if the magnetic card 12 is inserted. Further, the length from the receipt discharge port 40-2 to the front end of the lower guide 27 is preferably less than the length of the magnetic card 12 in the insertion direction so that the magnetic card 12 abuts against the front end of the lower guide 27 before the magnetic card 12 is completely inserted.

In the above-described configuration, the receipt 22 is conveyed by the feeding rollers 18 to 21, and is guided toward the receipt discharge section 32 by the upper guide 25 and the lower guide 27. Since the gap G3 between the front end of the lower guide 27 and the upper guide surface of the receipt discharge section 32 is wider than the thickness of the receipt 22, the receipt 22 passes through the front end of the lower guide 27, and is discharged to the outside of the automatic transaction apparatus 1 from the receipt discharge port 40-2.

As described above, according to the second embodiment, the gap G3 between the front end of the lower guide 27 and the upper guide surface of the receipt discharge section 32 is wider than the thickness of the receipt 22, and is narrower than the thickness of the magnetic card 12. For this reason, the receipt 22 passes through between the front end of the lower guide 27 and the upper guide surface of the receipt discharge section 32, and can be normally discharged to the outside of the automatic transaction apparatus 1 from the receipt discharge port 40-2. Meanwhile, even if a customer tries to insert the magnetic card 12 into the receipt discharge port 40-2, since the magnetic card 12 abuts against the lower guide 27, it is possible to prevent a mistaken insertion of the magnetic card 12 to the receipt discharge port 40-2.

3-3 Third Embodiment

Figure 7:
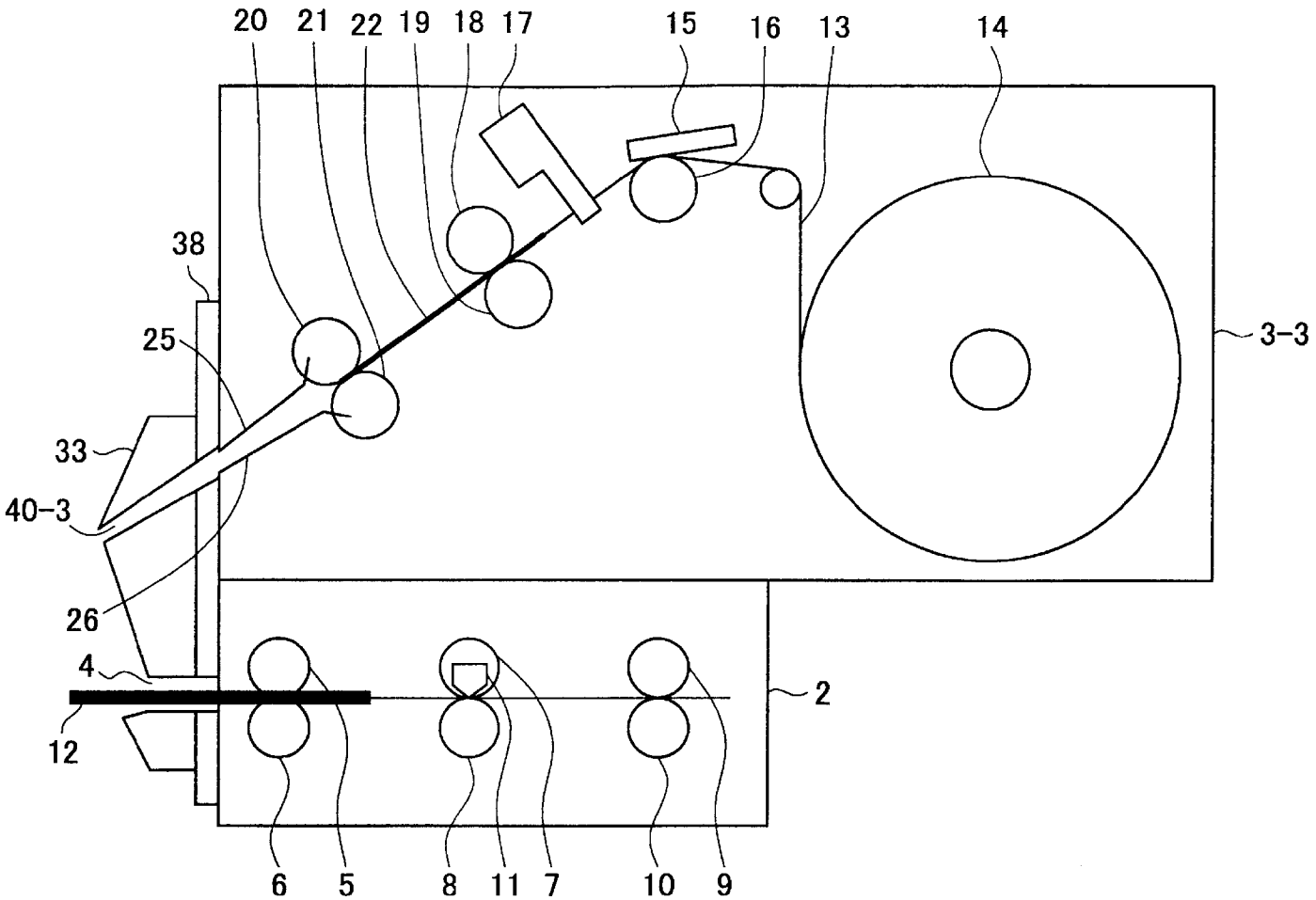
FIG. 7 is an explanatory diagram illustrating a configuration according to a third exemplary embodiment.
Figure 8:
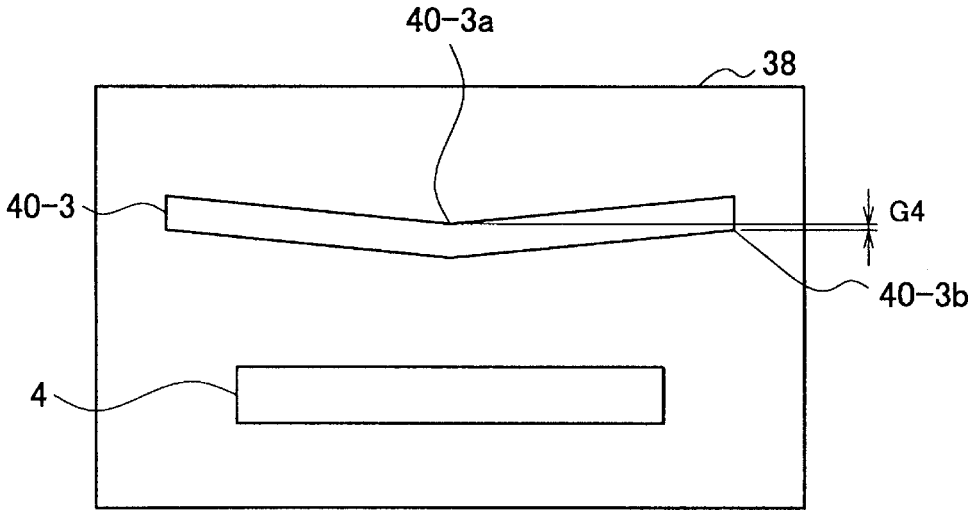
FIG. 8 is a front view of a card insert/discharge port and a receipt discharge port according to the third exemplary embodiment.

FIG. 7 is an explanatory diagram illustrating the configuration according to a third exemplary embodiment. FIG. 8 is a front view of the card insert/discharge port 4 and a receipt discharge port 40-3 according to the third embodiment. As illustrated in FIG. 7, the automatic transaction apparatus 1 according to the third embodiment includes the card reader/writer 2 and a receipt printer 3-3.

The receipt printer 3-3 according to the third embodiment includes the receipt roll 14 wound by the continuous paper 13, the thermal head 15, the platen 16, the cutter knife 17, the feeding rollers 18 to 21, the upper guide 25, and the lower guide 26. Further, a receipt discharge section 33 is mounted on the receipt printer 3-3 via a frame 38. The receipt discharge section 33 includes a receipt discharge port 40-3.

An upper edge and a lower edge of the receipt discharge port 40-3 according to the third embodiment are formed in a curved shape, more specifically, in a V-shape as illustrated in FIG. 8. In addition, a gap G4 between a lower end 40-3*a* of the upper edge and an upper end 40-3*b* of the lower edge is wider than the thickness of the receipt 22, and is narrower than the thickness of the magnetic card 12. Note that although FIG. 8 illustrates an example in which the lower end 40-3*a* of the upper edge is positioned upper than the upper end 40-3*b* of the lower edge, the lower end 40-3*a* of the upper edge may be positioned lower than the upper end 40-3*b* of the lower edge.

In the above-described configuration, the receipt 22 is conveyed by the feeding rollers 18 to 21, and is guided toward the receipt discharge section 33 by the upper guide 25 and the lower guide 26. The receipt 22 can be normally discharged following the V-shape of the receipt discharge port 40-3.

As described above, according to the third embodiment, the receipt 22 can be normally discharged following the V-shape of the receipt discharge port 40-3. Meanwhile, since the gap G4 between the lower end 40-3*a* of the upper edge and the upper end 40-3*b* of the lower edge is narrower than the thickness of the magnetic card 12, it is possible to prevent a mistaken insertion of the magnetic card 12 to the receipt discharge port 40-3.

In addition, according to the third embodiment, since the receipt 22 can be discharged in a state in which being bent in the V-shape, it is possible to improve the rigidity of the receipt 22 to be discharged. This feature will be described in detail with reference to FIG. 9.

Figure 9:
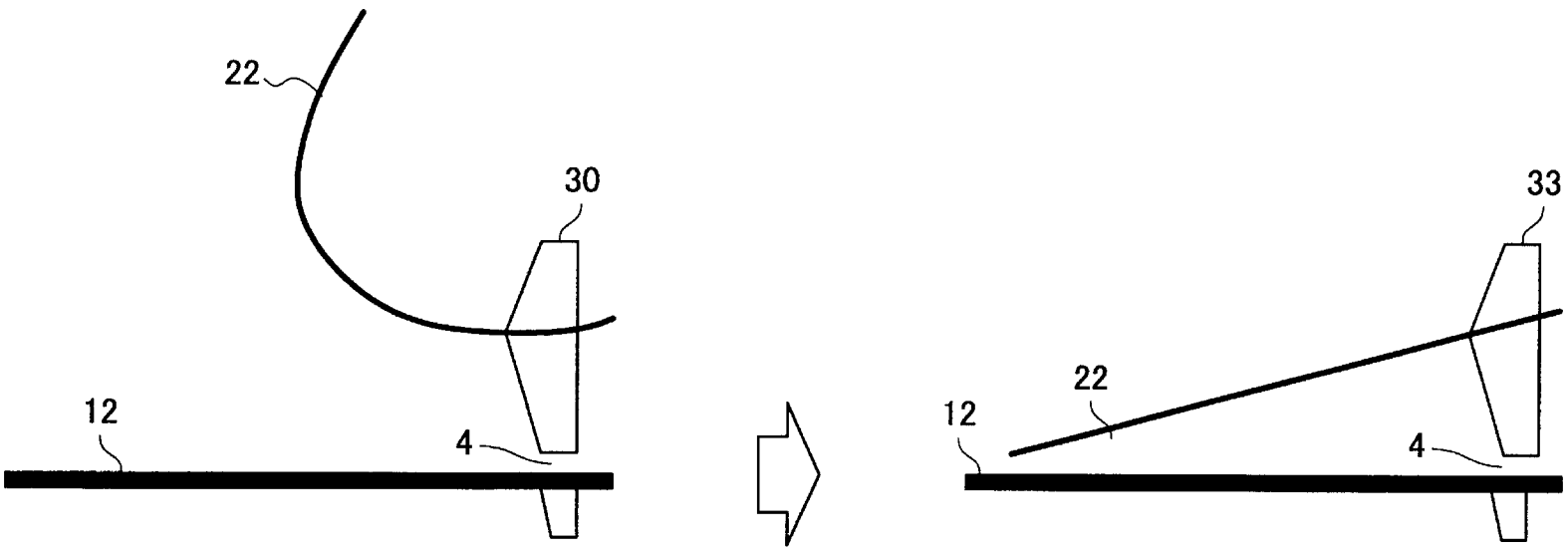
FIG. 9 is an explanatory diagram illustrating discharge of a receipt according to the third exemplary embodiment.

FIG. 9 is an explanatory diagram illustrating the discharge of the receipt 22 according to the third embodiment. As illustrated in the left drawing in FIG. 9, in the comparative example, when the receipt 22 cut from the roll of paper is discharged from the receipt discharge section 30, the receipt 22 will be curled. Accordingly, even though the receipt discharge section 30 is placed adjacent to the card insert/discharge port 4, it is difficult for the customer to receive the receipt 22 and the magnetic card 12 in a single movement.

However, according to the third embodiment, as described above, since the rigidity of the receipt 22 becomes high (that is, the strength is improved), as illustrated in the right drawing in FIG. 9, the curling is suppressed when the receipt 22 is discharged. As a result, the customer can easily receive the receipt 22 and the magnetic card 12 in a single movement.

Figure 10:
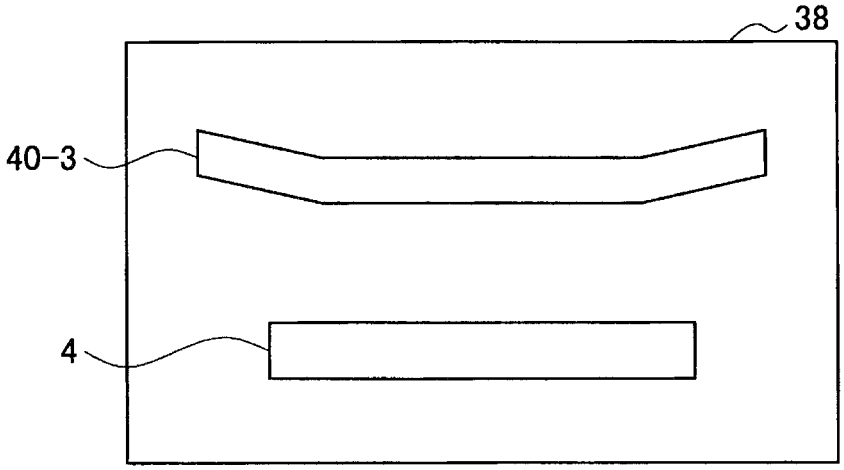
FIG. 10 is an explanatory diagram showing a modification of a shape of the receipt discharge port.
Figure 11:
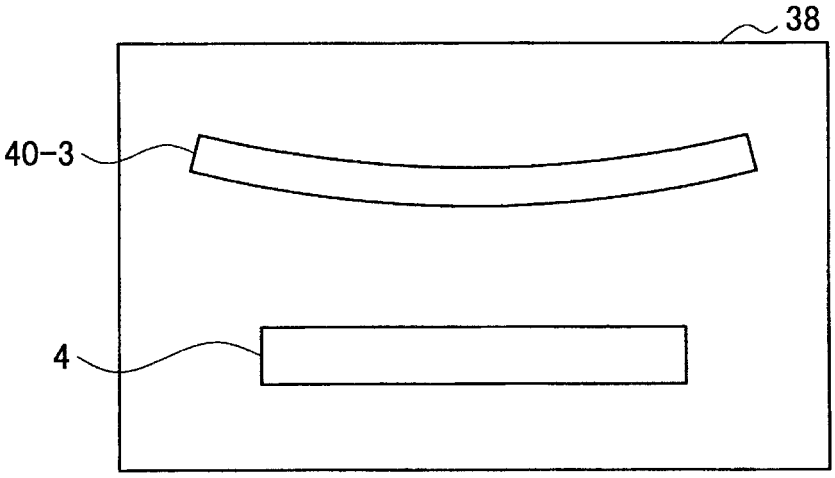
FIG. 11 is an explanatory diagram showing a modification of a shape of the receipt discharge port.

Note that although an example of forming the receipt discharge port 40-3 in a V-shape is described above, the receipt discharge port 40-3 may be formed in an inverted V-shape. Further, the V-shape is merely illustrated as one example of a curved shape, and the shape of the receipt discharge port 40-3 is not limited to the V-shape. For example, the receipt discharge port 40-3 may be formed in a trapezoidal shape, as illustrated in FIG. 10, or may be formed in an arc shape, as illustrated in FIG. 11.

3-4 Fourth Embodiment

Figure 12:
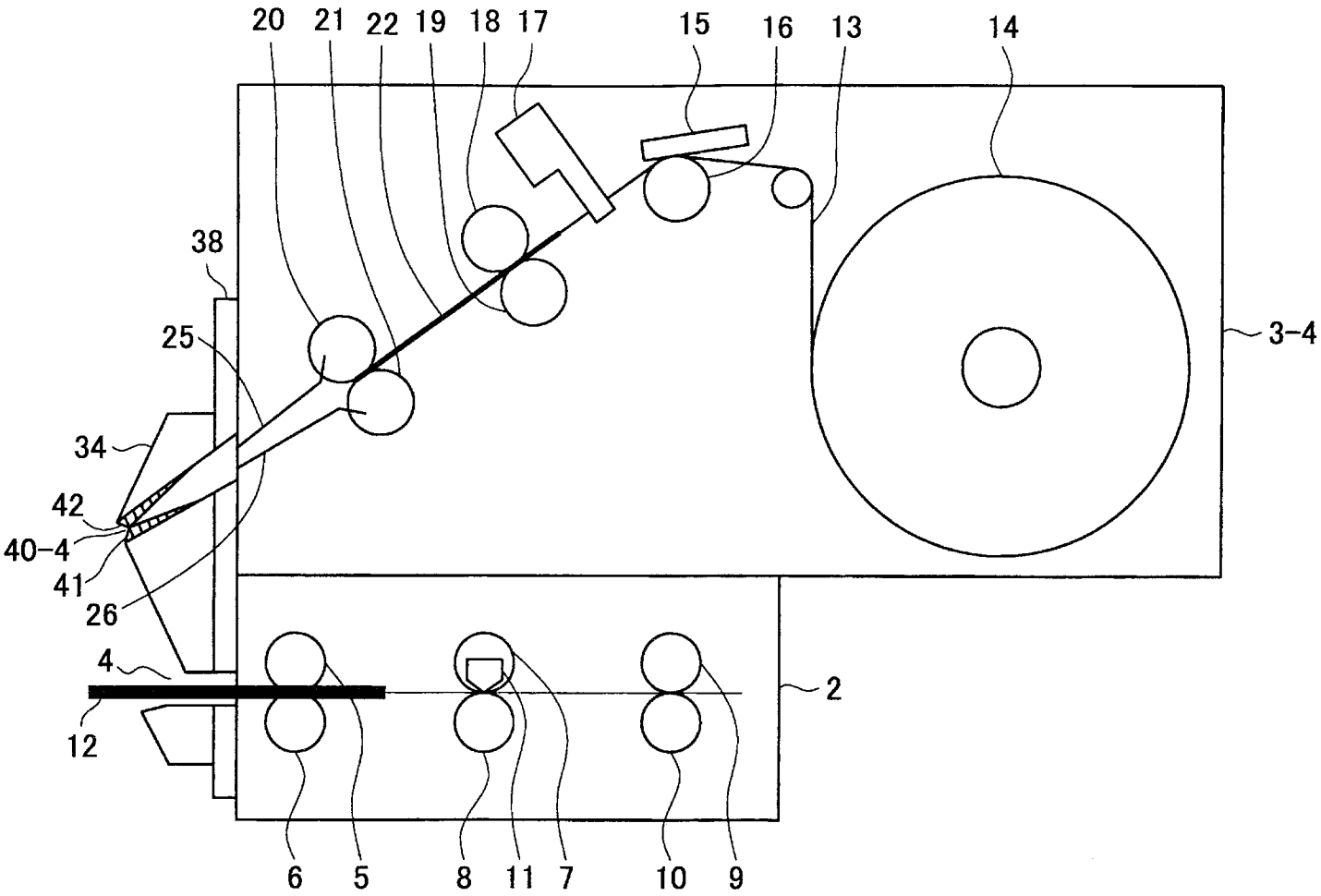
FIG. 12 is an explanatory diagram illustrating a configuration according to a fourth exemplary embodiment.
Figure 13:
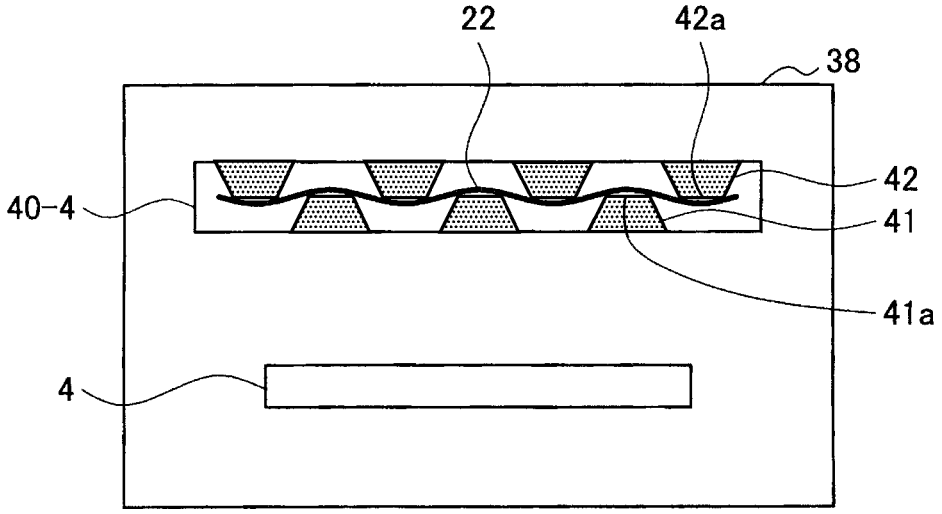
FIG. 13 is a front view of a card insert/discharge port and a receipt discharge port according to the fourth exemplary embodiment.

FIG. 12 is an explanatory diagram illustrating the configuration according to a fourth exemplary embodiment. FIG. 13 is a front view of the card insert/discharge port 4 and a receipt discharge port 40-4 according to the fourth embodiment. As illustrated in FIG. 12, the automatic transaction apparatus 1 according to the fourth embodiment includes the card reader/writer 2 and a receipt printer 3-4.

The receipt printer 3-4 according to the fourth embodiment includes the receipt roll 14 wound by the continuous paper 13, the thermal head 15, the platen 16, the cutter knife 17, the feeding rollers 18 to 21, the upper guide 25, and the lower guide 26. Further, a receipt discharge section 34 is mounted on the receipt printer 3-4 via the frame 38. The receipt discharge section 34 includes the receipt discharge port 40-4, a lower protrusion member 41, and an upper protrusion member 42.

The lower protrusion member 41 is a rib protrusion formed on the lower guide surface of the receipt discharge port 40-4, and the upper protrusion member 42 is a rib protrusion formed on the upper guide surface of the receipt discharge port 40-4. Although FIG. 13 illustrates an example in which three lower protrusion members 41 and four upper protrusion members 42 are provided, the number of each of the upper and lower protrusion members is not particularly limited. As illustrated in FIG. 13, the lower protrusion member 41 and the upper protrusion member 42 are disposed alternately at different positions in a width direction of the receipt discharge port 40-4.

Further, a gap between the lower end portion 42*a* of the upper protrusion member 42 and the upper end portion 41*a* of the lower end protrusion member 41 is wider than the thickness of the receipt 22, and is narrower than the thickness of the magnetic card 12. The lower end portion 42*a* of the upper protrusion member 42 may be positioned at a position lower than the upper end portion 41*a* of the lower end protrusion member 41. That is, the lower protrusion member 41 and the upper protrusion member 42 may be overlapped each other in the thick direction of the receipt 22.

In the above-described configuration, the receipt 22 is conveyed by the feeding rollers 18 to 21, and is guided toward the receipt discharge section 33 by the upper guide 25 and the lower guide 26. The receipt 22 is normally discharged in a corrugated shape by the lower protrusion member 41 and the upper protrusion member 42 of the receipt discharge port 40-4.

As described above, according to the fourth embodiment, the receipt 22 is normally discharged in a corrugated shape from the receipt discharge port 40-4. Meanwhile, the lower protrusion member 41 and the upper protrusion member 42 can prevent a mistaken insertion of the magnetic card 12 to the receipt discharge port 40-4.

Further, according to the fourth embodiment, since the lower protrusion member 41 and the upper protrusion member 42 are overlapped each other in the thick direction of the receipt 22, it is possible to prevent the insertion of a medium which is thinner than the magnetic card 12, as well as the magnetic card 12.

Furthermore, according to the fourth embodiment, since the receipt 22 is discharged in a corrugated shape, the rigidity of the discharged receipt 22 can be improved, as well as in the third embodiment. Therefore, according also to the fourth embodiment, since the curling of the receipt 22 can be suppressed when the receipt 22 is discharged, the customer can easily receive the receipt 22 and the magnetic card 12 in a single movement.

3-5 Fifth Embodiment

Figure 14:
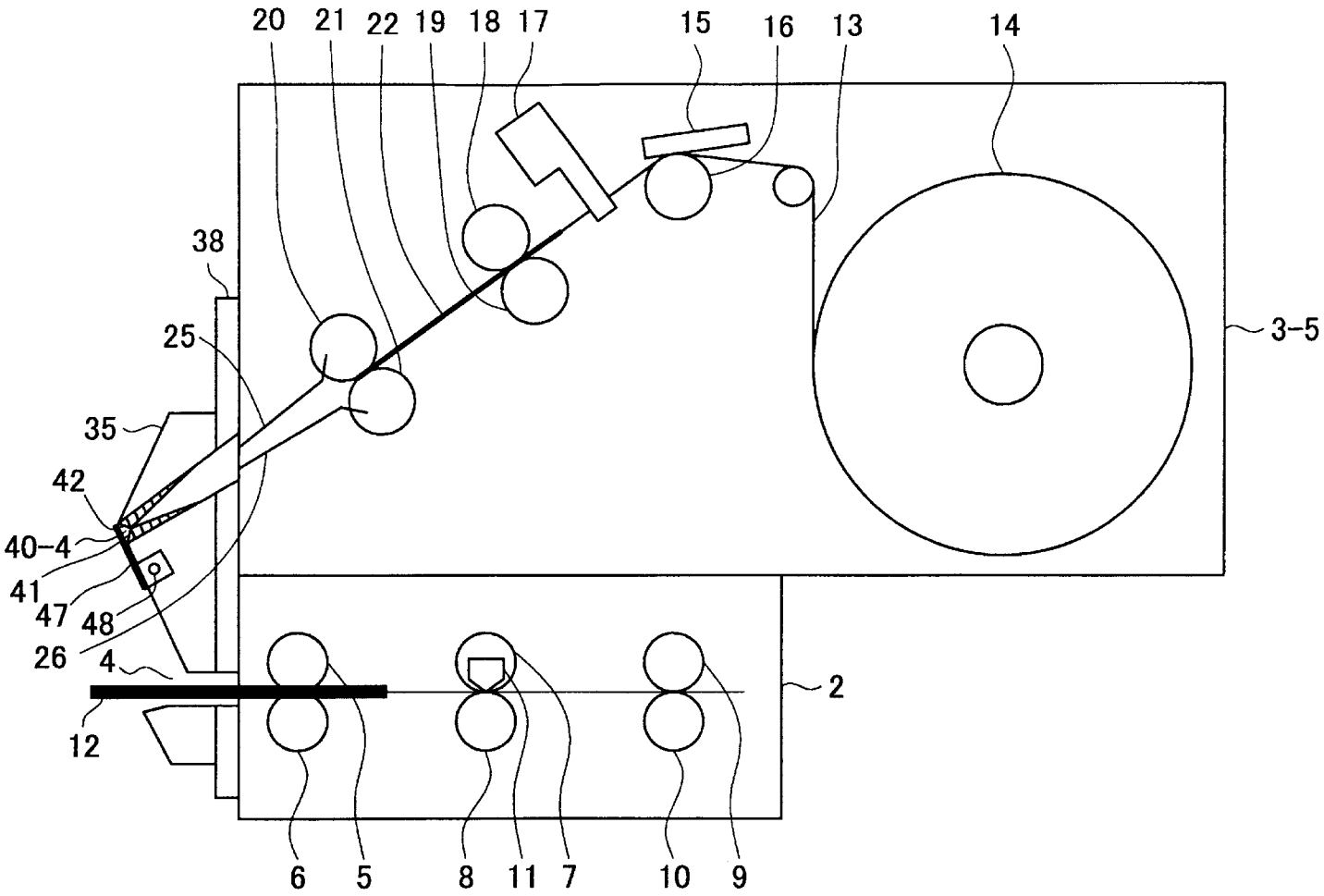
FIG. 14 is an explanatory diagram illustrating a configuration according to a fifth exemplary embodiment.

FIG. 14 is an explanatory diagram illustrating the configuration according to a fifth exemplary embodiment. As illustrated in FIG. 14, the automatic transaction apparatus 1 according to the fifth embodiment includes the card reader/writer 2 and a receipt printer 3-5.

The receipt printer 3-5 according to the fifth embodiment includes the receipt roll 14 wound by the continuous paper 13, the thermal head 15, the platen 16, the cutter knife 17, the feeding rollers 18 to 21, the upper guide 25, and the lower guide 26. Further, a receipt discharge section 35 is mounted on the receipt printer 3-5 via the frame 38. The receipt discharge section 35 further includes a discharge port shutter 47, in addition to the receipt discharge port 40-4, the lower protrusion member 41, and the upper protrusion member 42, which are described in the fourth embodiment.

The discharge port shutter 47 is provided rotatable around a point 48 in the receipt discharge port 40-4. The discharge port shutter 47 is urged in a direction covering the receipt discharge port 40-4 by an urging means (not illustrated) such as spring. The discharge port shutter 47 may have a size that can cover the entire width of the receipt discharge port 40-4.

In the above-described configuration, the receipt 22 is conveyed by the feeding rollers 18 to 21, and is guided toward the receipt discharge section 33 by the upper guide 25 and the lower guide 26. Since the receipt 22 is formed in a corrugated shape by the lower protrusion member 41 and the upper protrusion member 42 of the receipt discharge port 40-4, the receipt 22 is imparted improved rigidity. For this reason, the receipt 22 is normally discharged from the receipt discharge port 40-4 while pushing and opening the discharge port shutter 47 by itself.

As described above, according to the fifth embodiment, since the receipt discharge port 40-4 is covered by the discharge port shutter 47, it is possible to prevent not only the magnetic card 12 but also any foreign substances from being inserted into the receipt discharge port 40-4. In addition, according to the fifth embodiment, since the discharge port shutter 47 is pushed and opened due to the rigidity of the receipt 22, no actuator is necessary to open and close the discharge port shutter 47.

In the above description, an example is described in which the discharge port shutter 47 is combined with the configuration described in the fourth embodiment. However, since the rigidity of the receipt 22 is also improved by the third embodiment, the above-described configuration of the discharge port shutter 47 may be applied to the third embodiment.

3-6 Sixth Embodiment

Figure 15:
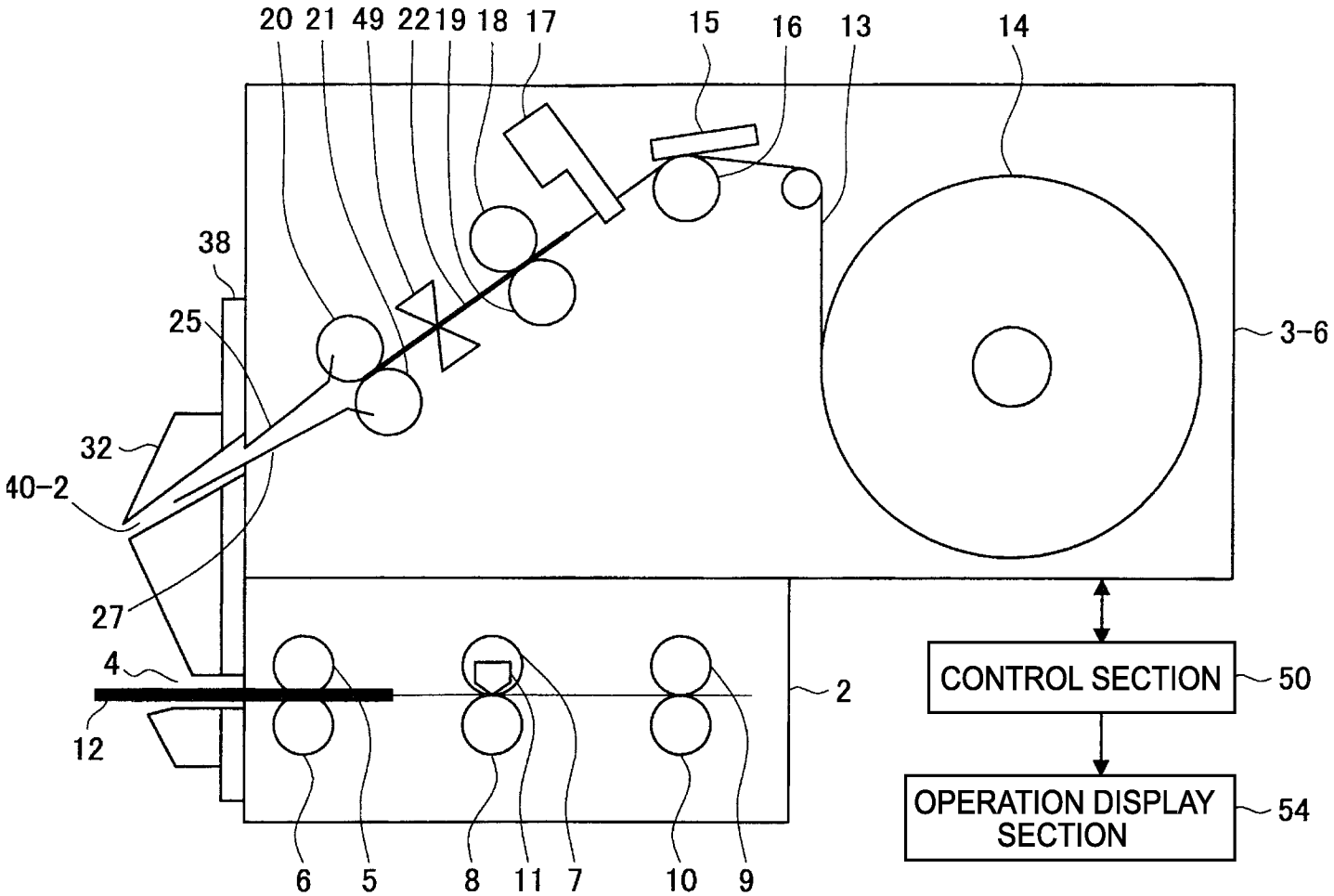
FIG. 15 is an explanatory diagram illustrating a configuration according to a sixth exemplary embodiment.

FIG. 15 is an explanatory diagram illustrating the configuration according to a sixth exemplary embodiment. As illustrated in FIG. 15, the automatic transaction apparatus 1 according to the sixth embodiment includes the card reader/writer 2, a receipt printer 3-6, a control section 50, and an operation display section 54.

The receipt printer 3-6 according to the sixth embodiment includes the receipt roll 14 wound by the continuous paper 13, the thermal head 15, the platen 16, the cutter knife 17, the feeding rollers 18 to 21, the upper guide 25, the lower guide 27, and a sensor 49. Further, the receipt discharge section 32 is mounted on the receipt printer 3-6 via the frame 38. The receipt discharge section 32 includes the receipt discharge port 40-2.

The sensor 49 is placed between the feeding rollers 18 and 19 and the feeding rollers 20 and 21 to detect the presence or absence of a medium. Note that the configuration of the receipt discharge section 32 is as described in the second embodiment.

The control section 50 controls the whole operation of the automatic transaction apparatus 1. In particular, in a case in which a foreign substance (for example, a medium, such as a point card, which is thinner than the magnetic card 12) is inserted through the receipt discharge port 40-2 and the sensor 49 detects a medium except when the discharging operation of the receipt 22, the control section 50 according to the sixth embodiment rotate the feeding rollers 18 to 21 in a direction of discharging the medium. After a predetermined time is lapsed since the medium is detected by the sensor 49, the control section 50 stops the rotation of the feeding rollers 18 to 21 and terminates the discharge control of the foreign substance.

Figure 16:
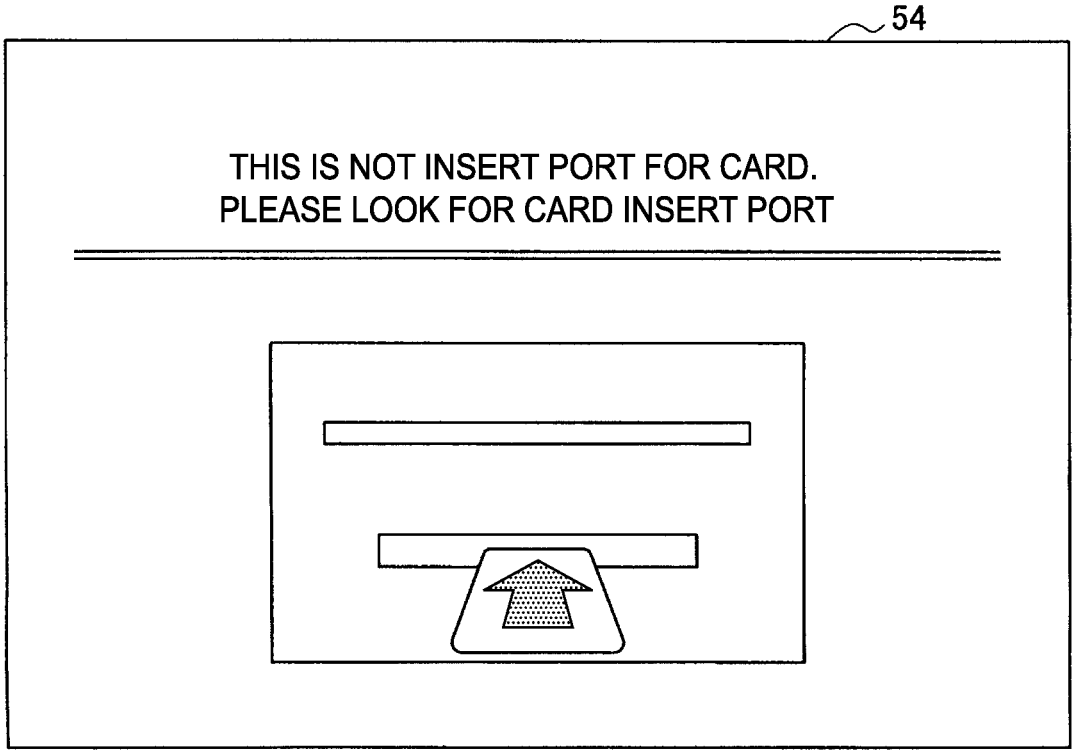
FIG. 16 is an explanatory diagram illustrating an example of a guidance screen for a customer (user)

Further, when a medium is detected by the sensor 49 except when the discharging operation of the receipt 22, the control section 50 may display a motion image (live-action film or animation) or a still image (photograph or illustration) on the operation display section 54 to guide a customer to a correct operation. For example, the control section 50 may display a message cautioning a customer and a screen showing a correct card insert port on the operation display section 54, as illustrated in FIG. 16.

As described above, according to the sixth embodiment, in a case in which a medium, such as a point card, which is thinner than the magnetic card 12, is inserted into the receipt discharge port 40-2 by mistake, the mistaken insertion is detected by the sensor 49, and the feeding rollers 18 to 21 are rotated in the direction of discharging the medium, so that the medium can be discharged from the receipt discharge port 40-2. The above-described sixth embodiment can be applied to the first embodiment, the third embodiment, or the fourth embodiment, as well as the second embodiment.

3-7 Seventh Embodiment

An automatic transaction apparatus 1 according to a seventh exemplary embodiment includes a receipt printer 3-6 having the sensor 49, as in the sixth embodiment.

If a medium is detected by the sensor 49 except when the discharging operation of the receipt 22, the control section 50 displays a motion image (live-action film or animation) or a still image (photograph or illustration) on the operation display section 54 to guide a customer to a correct operation. For example, the control section 50 may display a message cautioning a customer and a screen showing a correct card insert port on the operation display section 54, as illustrated in FIG. 16.

According to the seventh embodiment, it is possible to prevent a medium from being mistakenly inserted deep. The above-described seventh embodiment can be applied to any one of the first to sixth embodiments.

3-8 Eighth Embodiment

Figure 17:
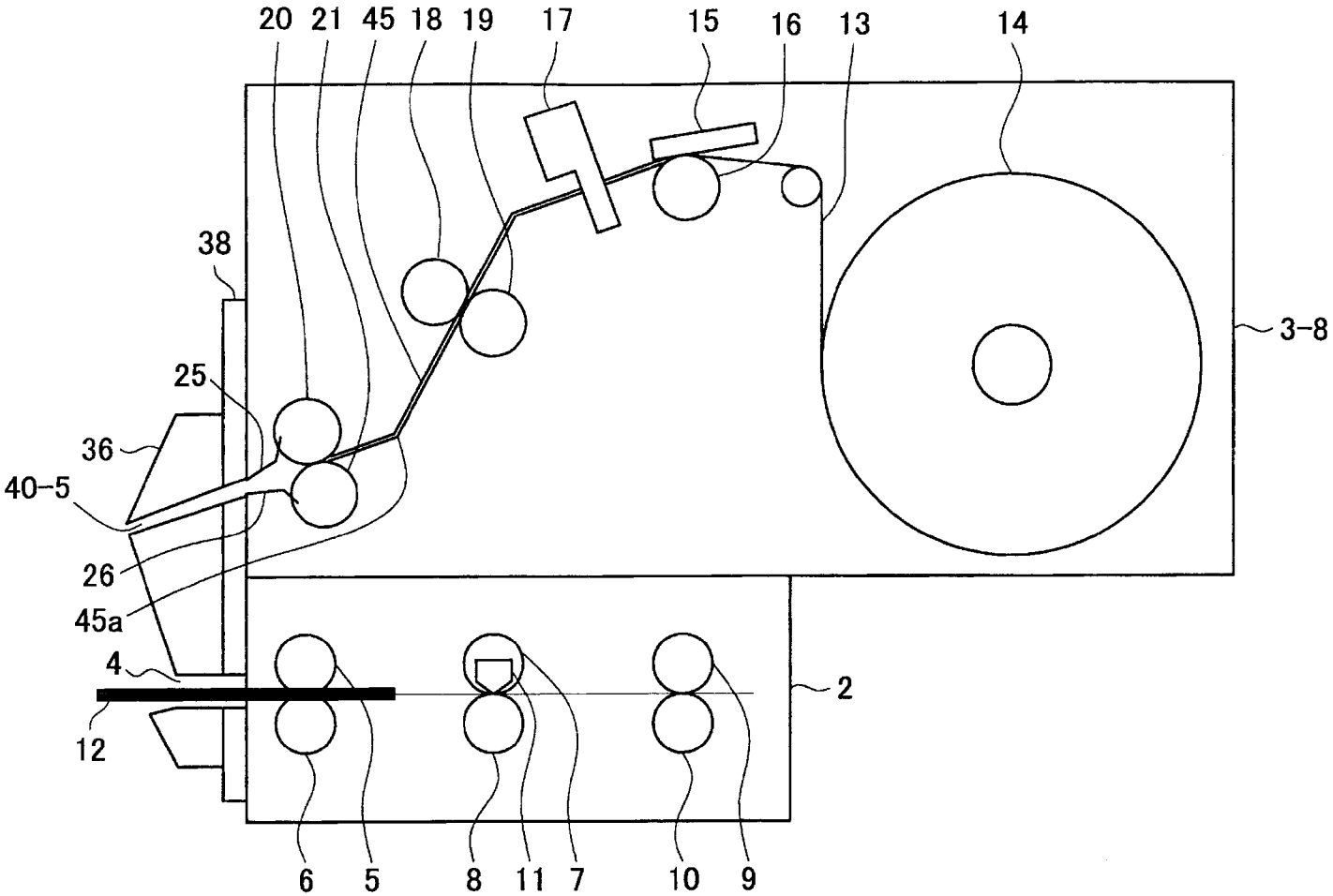
FIG. 17 is an explanatory diagram illustrating a configuration according to an eighth exemplary embodiment.

FIG. 17 is an explanatory diagram illustrating the configuration according to an eighth exemplary embodiment. As illustrated in FIG. 17, the automatic transaction apparatus 1 according to the eighth embodiment includes the card reader/writer 2 and a receipt printer 3-8.

The receipt printer 3-8 according to the eighth embodiment includes the receipt roll 14 wound by the continuous paper 13, the thermal head 15, the platen 16, the cutter knife 17, the feeding rollers 18 to 21, the upper guide 25, the lower guide 27, and a conveying path 45. Further, a receipt discharge section 36 is mounted on the receipt printer 3-8 via the frame 38. The receipt discharge section 36 includes a receipt discharge port 40-5.

The conveying path 45 of the receipt printer 3-8 is formed in a bent shape. Further, a length from the receipt discharge port 40-5 to a bent point **45*a* of the conveying path 45 is within the length of the magnetic card 12** in its insertion direction.

In the above-described configuration, the receipt 22 is conveyed on the conveying path 45 by the feeding rollers 18 to 21, and is guided toward the receipt discharge section 36. Since the receipt 22 which is a paper medium has high flexibility, the receipt 22 can pass through the bent point **45*a* of the conveying path 45. The receipt 22 is discharged from the receipt discharge port 40-5 of the receipt discharge section 36 to the outside of the automatic transaction apparatus 1**.

As described above, according to the eighth embodiment, the receipt 22 passes through the bent point **45*a*, and then is normally discharged from the receipt discharge port 40-5 to the outside of the automatic transaction apparatus 1. Meanwhile, in a case in which the magnetic card 12 is inserted into the receipt discharge port 40-5, the magnetic card 12 abuts against the bent point 45*a* of the conveying path 45, and cannot pass through the bent point 45*a* of the conveying path 45. Therefore, it is possible to prevent the whole magnetic card 12 from being mistakenly inserted into the receipt discharge port 40-5**.

As described above, according to the first embodiment to the eighth embodiment of the invention, it is possible to more reliably prevent a mistaken insertion of the magnetic card 12 into the receipt discharge port 40.

In addition, although the embodiments of the invention have been described in detail with reference to the accompanying drawings, the invention is not limited to the embodiments described herein. It is clear to those skilled in the art that various alterations or modifications can be readily conceived of based on the technical concept of the present invention defined by the appended claims, and these alterations or modifications are naturally appreciated to fall within the spirit or scope of the present invention. For example, although the method of applying the automatic transaction apparatus of the invention to ATM was described herein, the present invention can be applied to various automatic transaction apparatus such as an electronic money charging machine or a ticket-vending machine.

What is claimed is:

1. An automatic transaction apparatus comprising:

a card insert port into which a card medium is inserted;

a paper medium discharge section that includes a discharge port from which a paper medium is discharged; and a conveying path that guides a conveyance of the paper medium and discharge of the paper medium from the discharge port, a dimension of the conveying path in a thickness direction of the paper medium being smaller than a thickness of the card medium at least at one position of the conveying path along a conveying direction;

wherein an upper edge and a lower edge of the discharge port are formed in a straight line;

wherein the conveying path further includes a guide member that guides the paper medium toward the paper medium discharge section, and a gap between a front end of the guide member and a guide surface of the conveying path that is smaller than the thickness of the card medium; and wherein the guide member is positioned at a center of the paper medium discharge section in a direction orthogonal to the conveying direction.

2. The automatic transaction apparatus according to claim 1, wherein the conveying path includes a lower guide surface and an upper guide surface that guide a conveyance of the paper medium and discharge of the paper medium, and a protrusion member, a gap between a lower end of the protrusion member of the upper guide surface and an upper end of the protrusion member of the lower guide surface in the thickness direction being smaller than the thickness of the card medium.

3. The automatic transaction apparatus according to claim 2, wherein the lower end of the protrusion member of the upper guide surface is positioned at a position lower than the upper end of the protrusion member of the lower guide surface.

4. The automatic transaction apparatus according to claim 1, wherein the paper medium discharge section further includes a shutter that is urged in a direction to cover the discharge port.

5. The automatic transaction apparatus according to claim 1, further comprising:

a sensor that detects a foreign substance inside the conveying path; and a control section which, if the foreign substance is detected by the sensor when the paper medium is not being conveyed, controls conveyance of the foreign substance to discharge the foreign substance.

6. The automatic transaction apparatus according to claim 5, further comprising a display section, wherein if the foreign substance is detected by the sensor, the control section displays a guidance screen on the display section, which guides a user through a correction operation.

7. The automatic transaction apparatus according to claim 1, wherein a distance between the at least one position of the conveying path and the discharge port along the conveying direction is less than a length of the card medium in an insertion direction from the discharge port.

8. The automatic transaction apparatus according to claim 1, wherein a shape of the discharge port and the gap between the upper edge and the lower edge of the discharge port are visible.

9. The automatic transaction apparatus according to claim 1, wherein the paper medium is a paper receipt.

10. An automatic transaction apparatus comprising:

a card insert port into which a card medium is inserted;

a paper medium discharge section that includes a discharge port from which a paper medium is discharged; and a conveying path that guides a conveyance of the paper medium and discharge of the paper medium from the discharge port, a dimension of the conveying path in a thickness direction of the paper medium being smaller than a thickness of the card medium at least at one position of the conveying path along a conveying direction;

wherein the paper medium discharge section further includes a shutter that is configured to prevent insertion of the card medium, the shutter being configured to discharge a paper medium while being pushed and opened by the paper medium contacting the shutter; and wherein the shutter is rotatable.

11. The automatic transaction apparatus according to claim 10, wherein the paper medium is a paper receipt.

* * * * *